US007487690B2

(12) United States Patent
Liu

(10) Patent No.: US 7,487,690 B2
(45) Date of Patent: Feb. 10, 2009

(54) ELEVATING MECHANISM FOR FURNITURE

(76) Inventor: Chih Way Liu, 235 Chung-Ho Box, 8-24 Taipei (TW)

( * ) Notice: Subject to any disclaimer, the term of this patent is extended or adjusted under 35 U.S.C. 154(b) by 656 days.

(21) Appl. No.: 11/047,485

(22) Filed: Feb. 1, 2005

(65) Prior Publication Data

US 2006/0169862 A1 Aug. 3, 2006

(51) Int. Cl.
*F16H 3/06* (2006.01)

(52) U.S. Cl. ..... 74/89.45; 108/147

(58) Field of Classification Search ..... 74/89.14, 74/89.29, 89.35, 89.45; 108/144.11, 147; 248/188.2, 188.5, 188.8, 292.12
See application file for complete search history.

(56) References Cited

U.S. PATENT DOCUMENTS 3,405,931 A * 10/1968 Anderson ..... 5/612
6,024,025 A * 2/2000 Koch et al. ..... 108/147
6,289,825 B1 * 9/2001 Long ..... 108/147
6,474,246 B2 * 11/2002 Hsu ..... 108/147
6,935,250 B1 * 8/2005 Arnold ..... 108/147

* cited by examiner

*Primary Examiner*—Richard W Ridley
*Assistant Examiner*—Matthew Johnson

(57) ABSTRACT

An elevating mechanism for furniture installed in a height adjustable article of furniture includes a transmission unit and a rotary handle. The transmission unit utilizes a plurality of cylindrical gears mounted on respective shafts, such that the cylindrical gears will be engaged and rotate simultaneously. A rotary handle serves to activate a rotation of a bolt with respect to a still nut and an upward or downward motion of the article connected to the bolt with respect to the article on which the nut is mounted.

4 Claims, 12 Drawing Sheets

ELEVATING MECHANISM FOR FURNITURE

FIELD OF THE INVENTION

The present invention relates to elevating mechanisms for furniture, more particularly to an elevating mechanism for furniture utilizing a plurality of cylindrical gears mounted on respective shafts for a multi-directional motion control.

BACKGROUND OF THE INVENTION

The invention of the prior art disclosed by R.O.C. (Taiwan) patent number 595342 with a title of office desk structure, issued to the applicant, is for adjusting the height of the desk top of an office desk. The invention comprises a desk top, a base frame having a base and a sleeve mount, and a synchronic elevating mechanism installed at a selected place within the desk body. The bolt of tile prior art is inserted in the sleeve mount of the base frame. The transmission shaft of the invention comprises a bevel gear for transmission and a bevel gear for elevation. The invention further includes a turning handle for driving the elevating mechanism whereby height adjustment of a desk can be realized.

The elevating mechanism of the prior art, which utilizes the engagement of a bevel gear for transmission and a bevel gear for elevation, has the following disadvantages.

1. The engagement of the bevel gears has a small interface and therefore is easy to collapse.

2. The combination of the bevel gears may contain an error in the engagement, which will result in noises when operated. It may also cause off-axis of at least one bevel gear and consequently a collapse of the engagement.

3. The handle is installed at a fixed position, and therefore the operation of the handle may be hindered in a tight space.

SUMMARY OF THE INVENTION

Accordingly, the primary objective of the present invention is to provide an elevating mechanism for furniture utilizes a plurality of cylindrical gears mounted on respective shafts, whereby the cylindrical gears will be engaged and rotate simultaneously. The innovative functions of the elevating mechanism for furniture are listed as follows.

1. An elevating mechanism for furniture according to the present invention is a combination of cylindrical gears; the engagement of the gear teeth is more secure. Therefore, the transmission unit thereby formed can sustain larger loads without enhancing the material strength of the gears.

2. The elevating mechanism for furniture comprises three cylindrical gears, and therefore has a stable structure and is immune from misalignment. The assembly of this mechanism to an article of furniture will not produce much noise.

3. The rotary handle can be applied to several places in the elevating mechanism for furniture, which makes the elevating operation very flexible.

4. Two sets of the elevating mechanism for furniture can be combined by sharing a common transmission shaft, and therefore the motions of two sets are collateral, allowing a stable elevation for larger articles of furniture.

The various objects and advantages of the present invention will be more readily understood from the following detailed description when read in conjunction with the appended drawings.

DETAILED DESCRIPTION OF THE PREFERRED EMBODIMENTS

Figure 1:
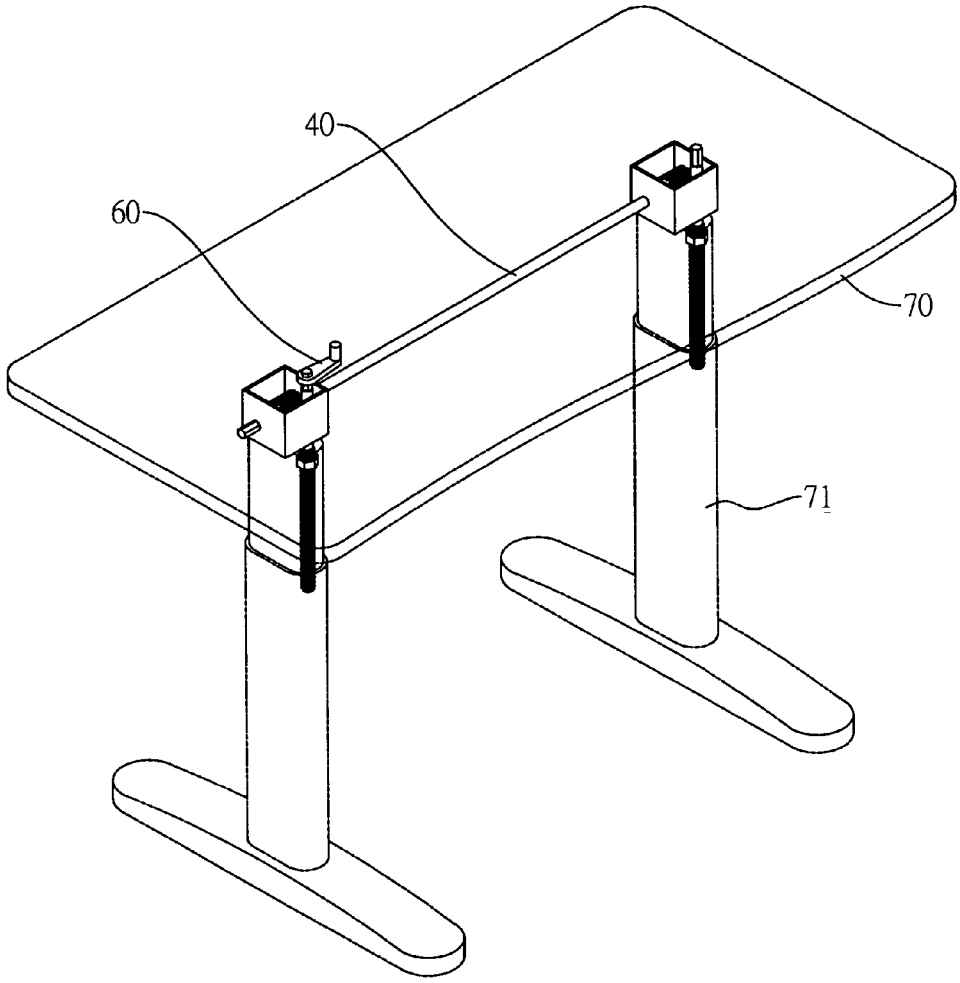
FIG. 1 is a perspective view of an elevating mechanism for furniture according to the present invention installed within a table.
Figure 2:
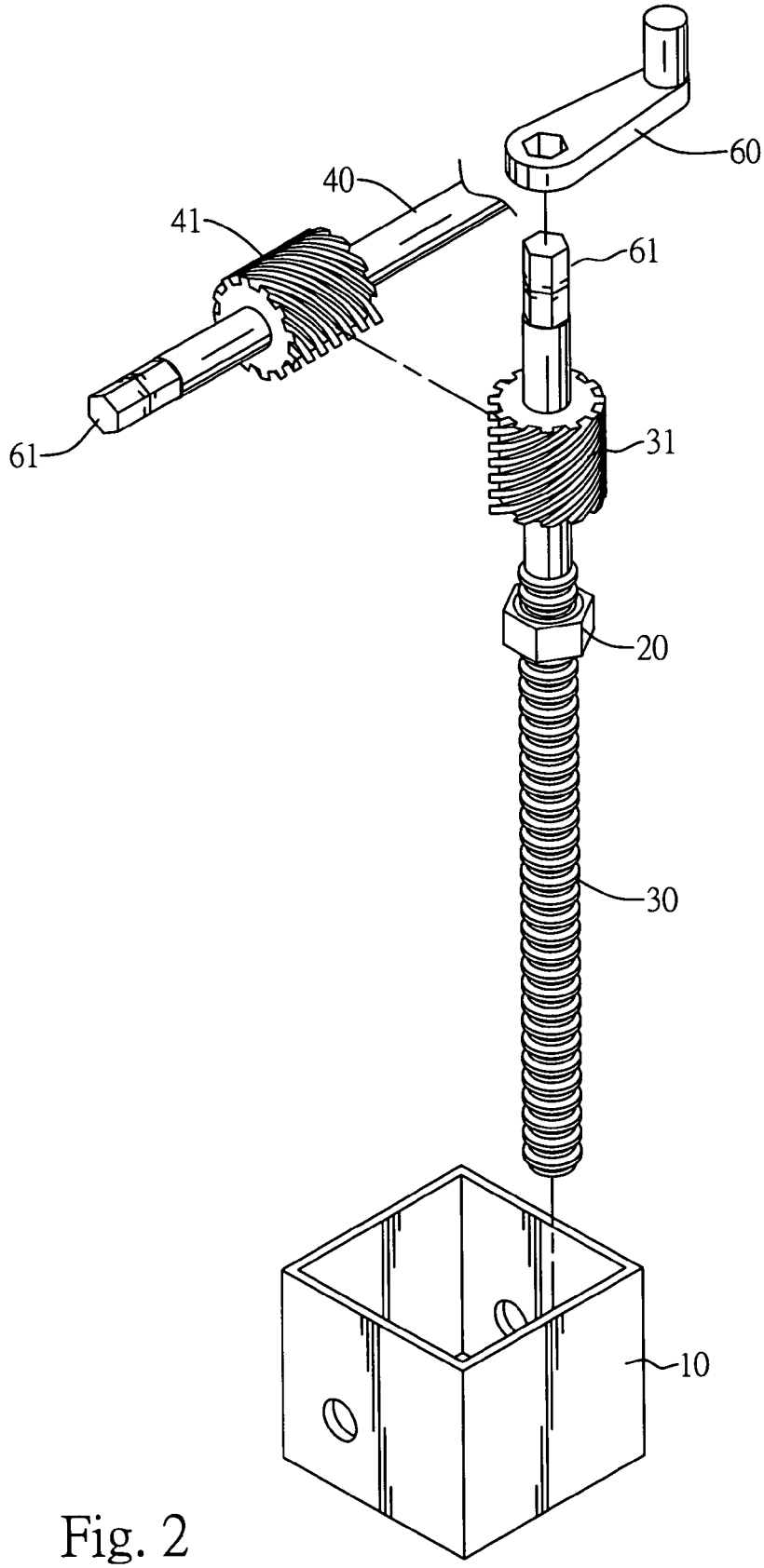
FIG. 2 is an exploded perspective view of the elevating mechanism for furniture in FIG. 1.
Figure 3:
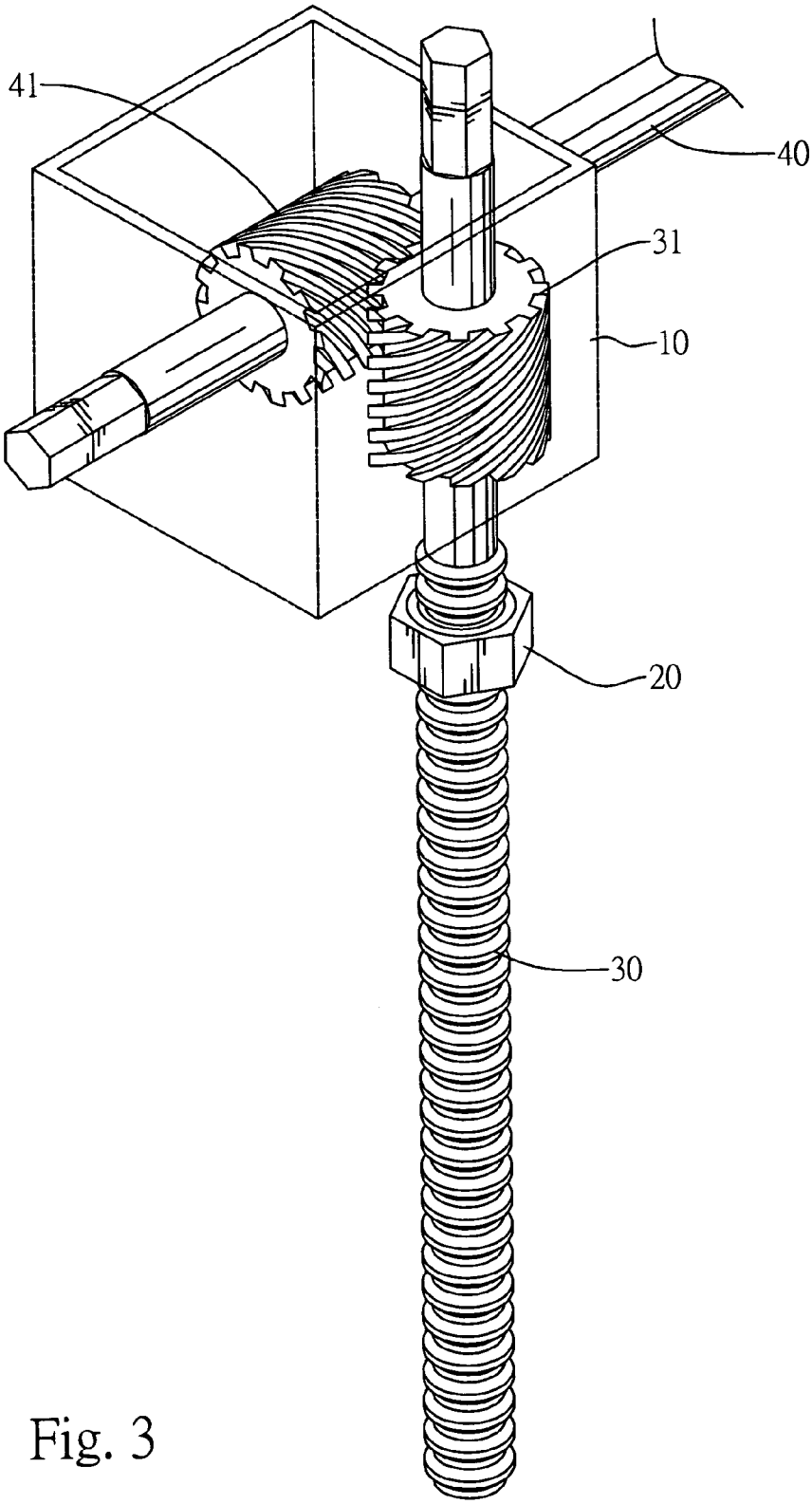
FIG. 3 is a perspective view of the elevating mechanism for furniture in FIG. 1.

Referring to FIGS. 1 and 2, the first preferred embodiment of the present invention as an elevating mechanism for furniture comprises a transmission unit, a rotary handle 60 and a box 10. The transmission unit further comprises a bolt 30 vertical to the ground, a first cylindrical gear 31 coaxially secured along a section of the bolt 30, a nut 20 engaged with a threaded section of the bolt 30, a horizontal transmission shaft 40 and a second cylindrical gear 41 coaxially secured along a section of the transmission shaft 40 and coupled with the first cylindrical gear 31 of bolt 30. The top end of the bolt 30 forms a short post 61 with a polygonal cross section, and two ends of the transmission shaft 40 form other two short posts 61 with the same polygonal cross section. The rotary handle 60 is provided with a polygonal hole taking substantially the same shape as the cross section of the short posts 61. The hole is for receiving either one of the short posts 61 so as to rotate the first cylindrical gear 31 or the second cylindrical gear 41. The box 10 houses the first cylindrical gear 31 and the second cylindrical gear 41.

Figure 4:
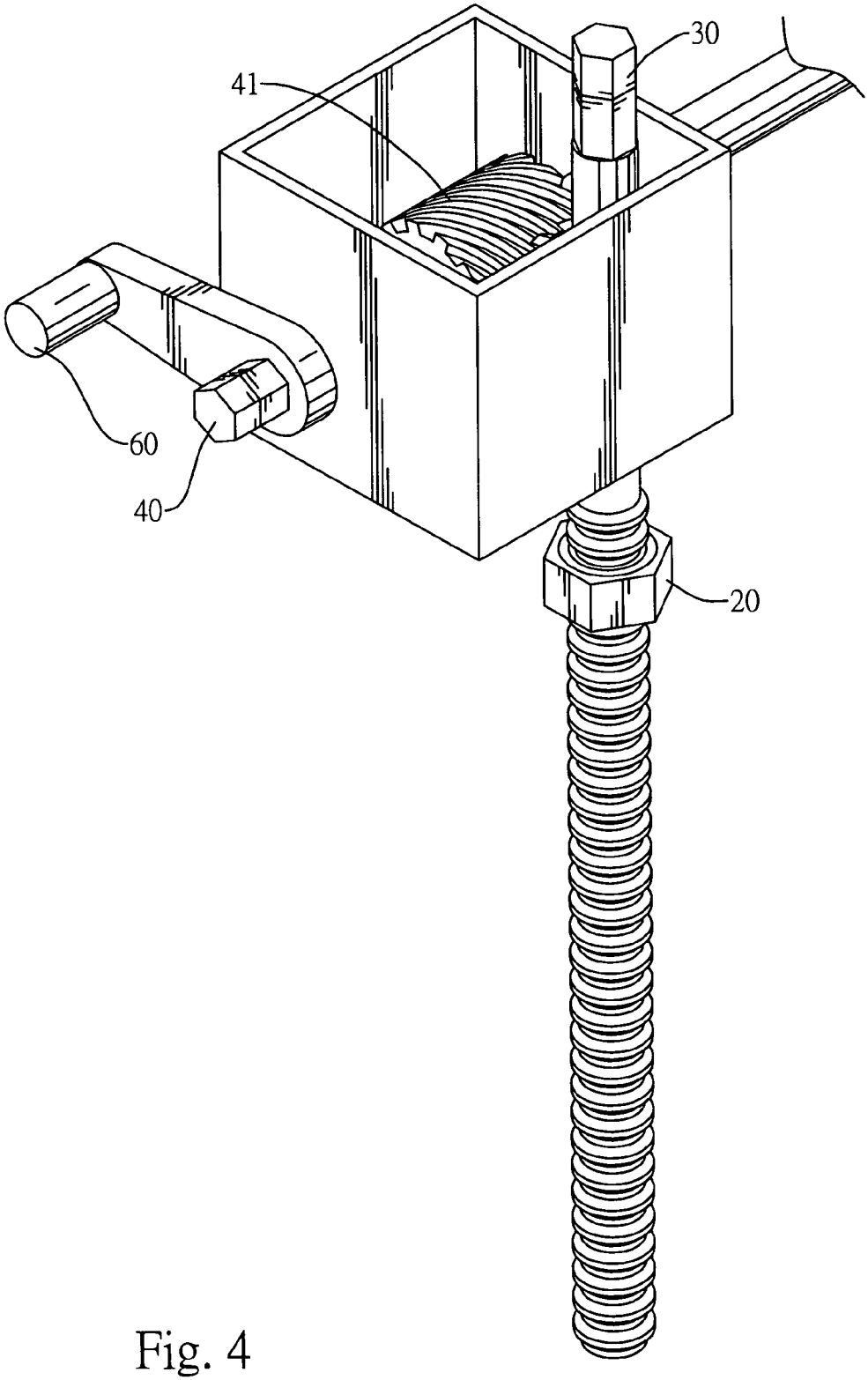
FIG. 4 is another perspective view of the elevating mechanism for furniture in FIG. 1.
Figure 5:
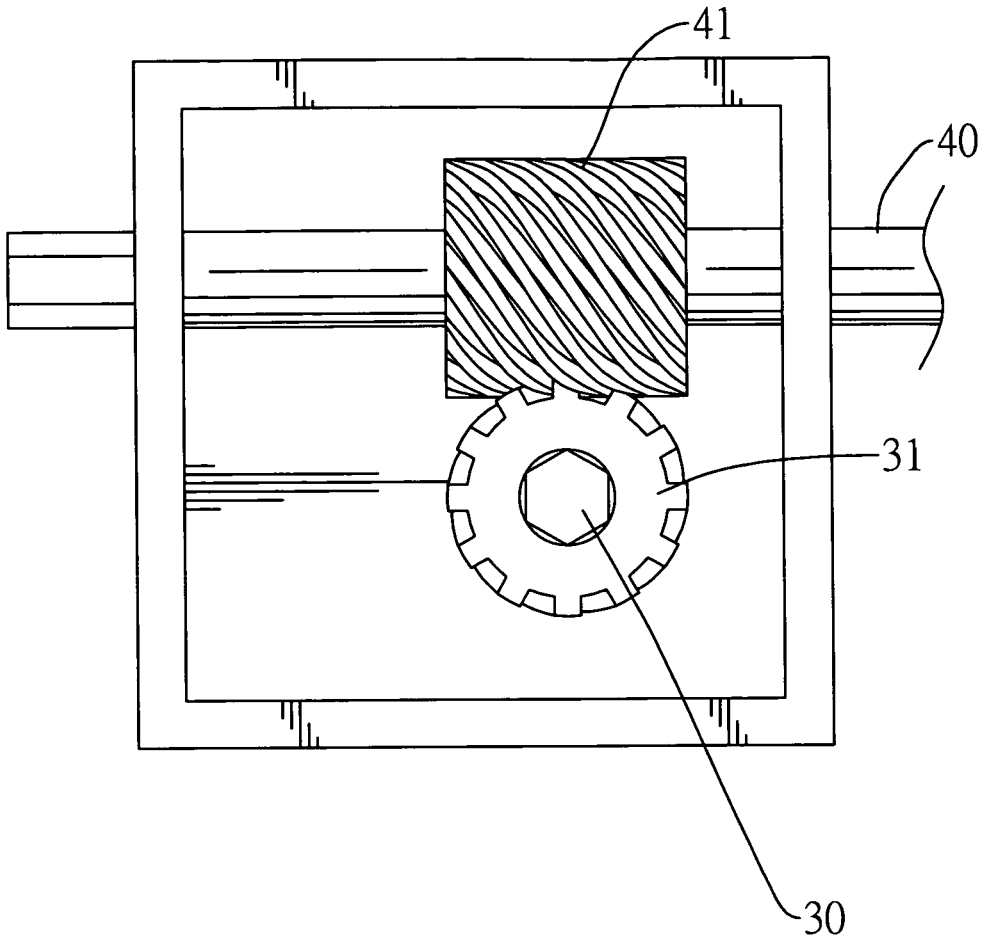
FIG. 5 is a top cross sectional view of the elevating mechanism for furniture in FIG. 1.
Figure 6:
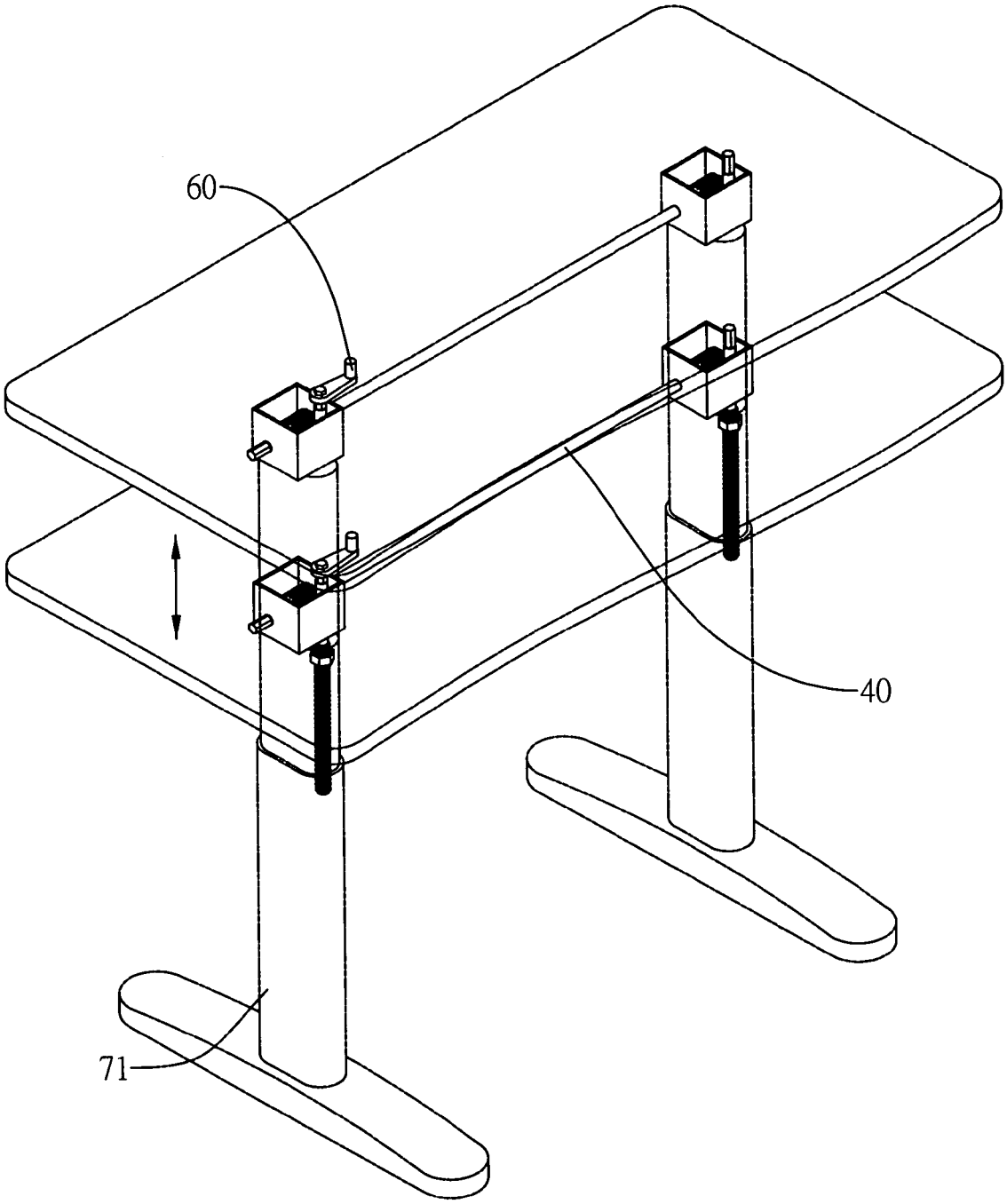
FIG. 6 illustrates the elevation of a desk equipped with the elevating mechanism for furniture.

Referring to FIGS. 4 and 5, since the first cylindrical gear 31 and the second cylindrical gear 41 are coupled, the rotation of the transmission shaft 40 will cause the bolt 30 to rotate simultaneously, whereby the rotary handle 60 will activate a rotation of the bolt 30 with respect to the still nut 20 and a upward or downward motion of the article connected to the bolt 30 with respect to the article on which the nut 20 is mounted.

Figure 7:
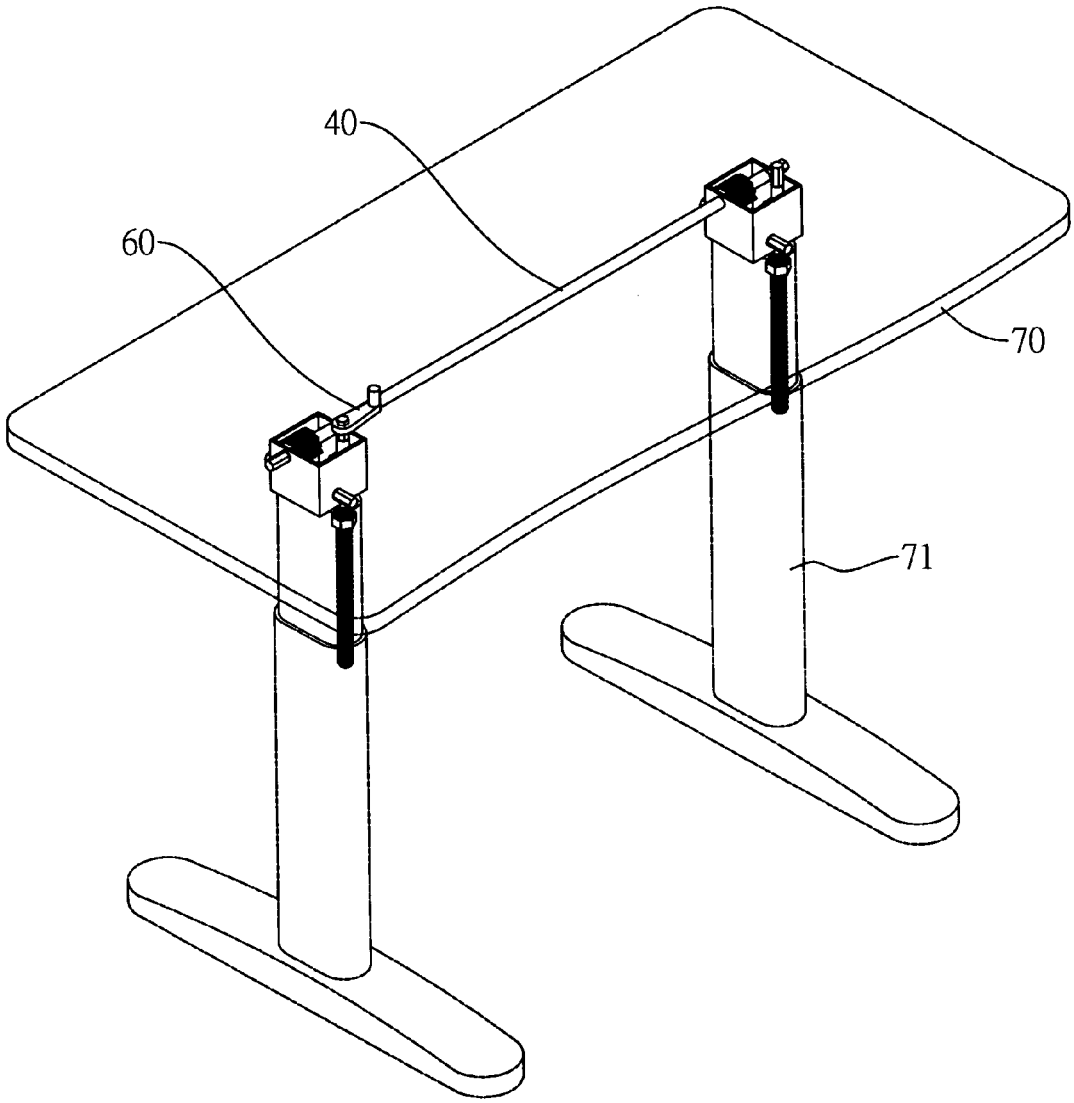
FIG. 7 is another perspective view of the elevating mechanism for furniture.

Referring to FIG. 7, two sets of the elevating mechanism for furniture are installed within two table legs 71 of a table so that the height of table top 70 of the table can be adjusted, in which process the table top 70 keeps horizontal. The nut 20 of each elevating mechanism for furniture is secured within a corresponding table leg 71 for receiving the insertion of the bolt 30; other parts of the elevating mechanism for furniture is then mounted on the top end of each table leg 71. The table top 70 is supported by two boxes 10 of two sets of elevating mechanism. Two sets of elevating mechanism share the same transmission shaft 40 so that they move collaterally.

Figure 12:
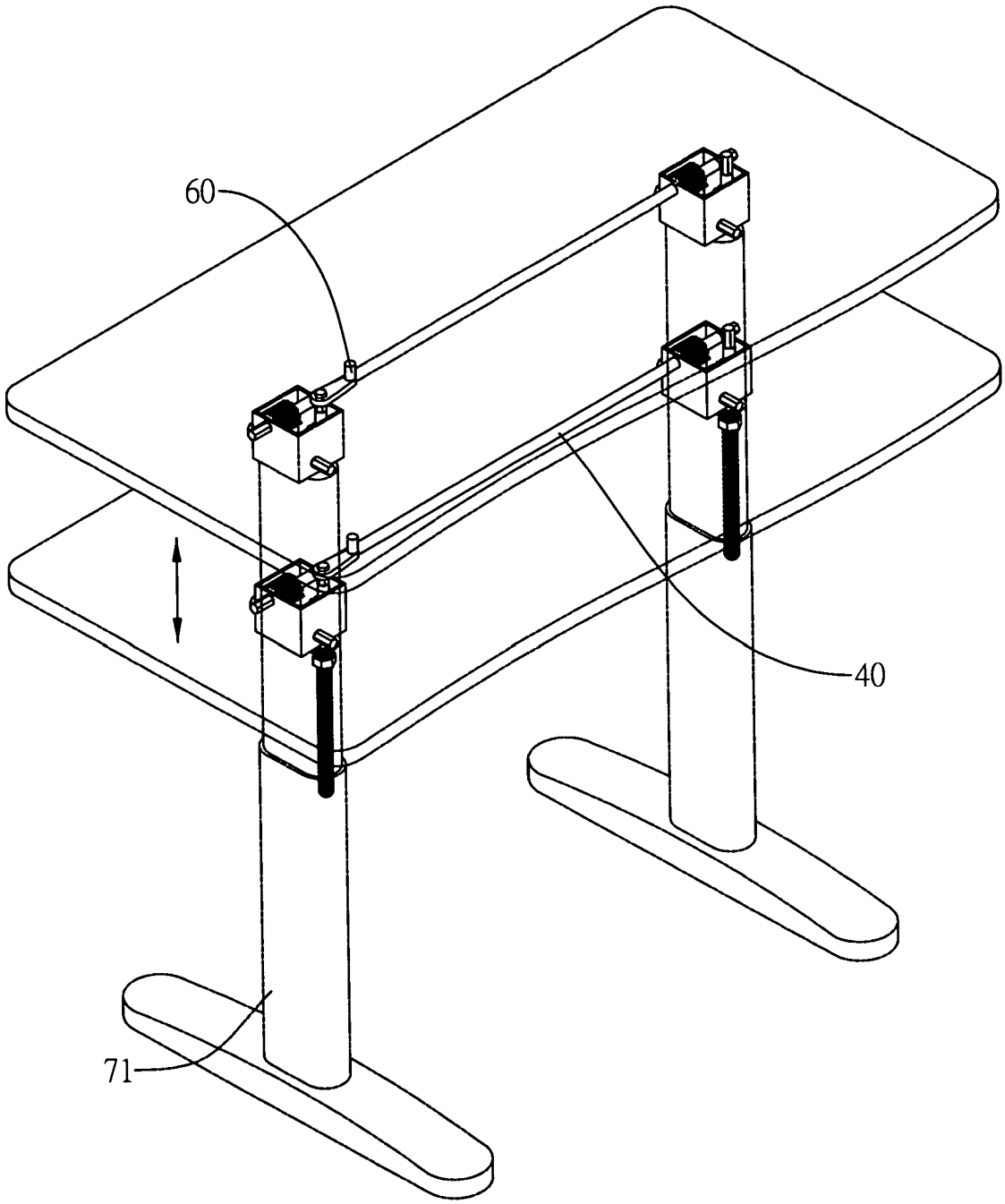
FIG. 12 illustrates the elevation of a desk equipped with the second preferred embodiment.

Referring to FIG. 12, the rotary handle 60 is connected to any of the short posts 61, whereby an external agent can urge a bolt 30 to rotate with respect to the associated nut 20. Because of the transmission unit, the other bolt 30 will move simultaneously with the bolt 30 being driven; therefore, the other bolt 30 will perform substantially the same rotation with respect to its associated nut 20. Thereby, two table legs 71 will be changing height at the same time.

Figure 8:
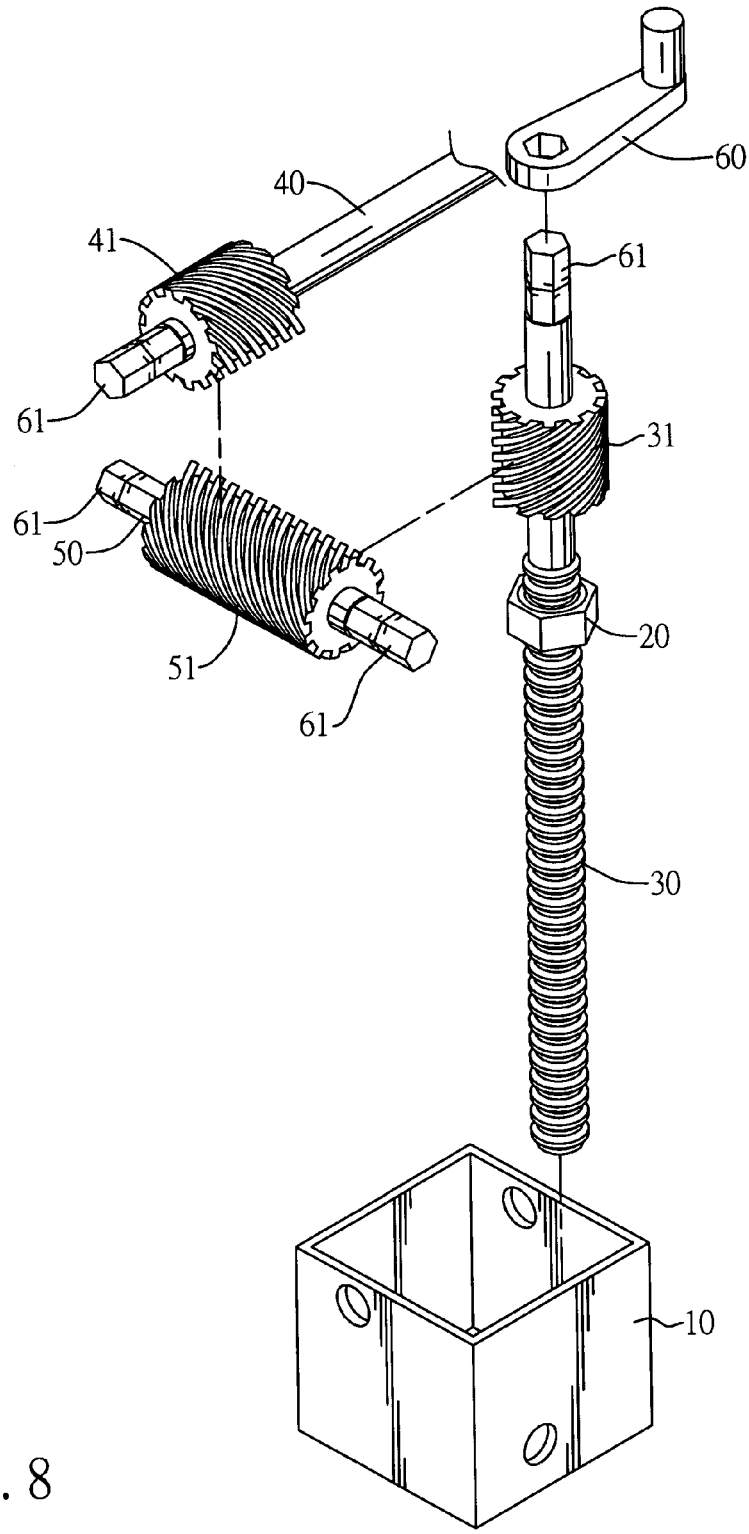
FIG. 8 is an exploded perspective view of the second preferred embodiment of the present invention.
Figure 9:
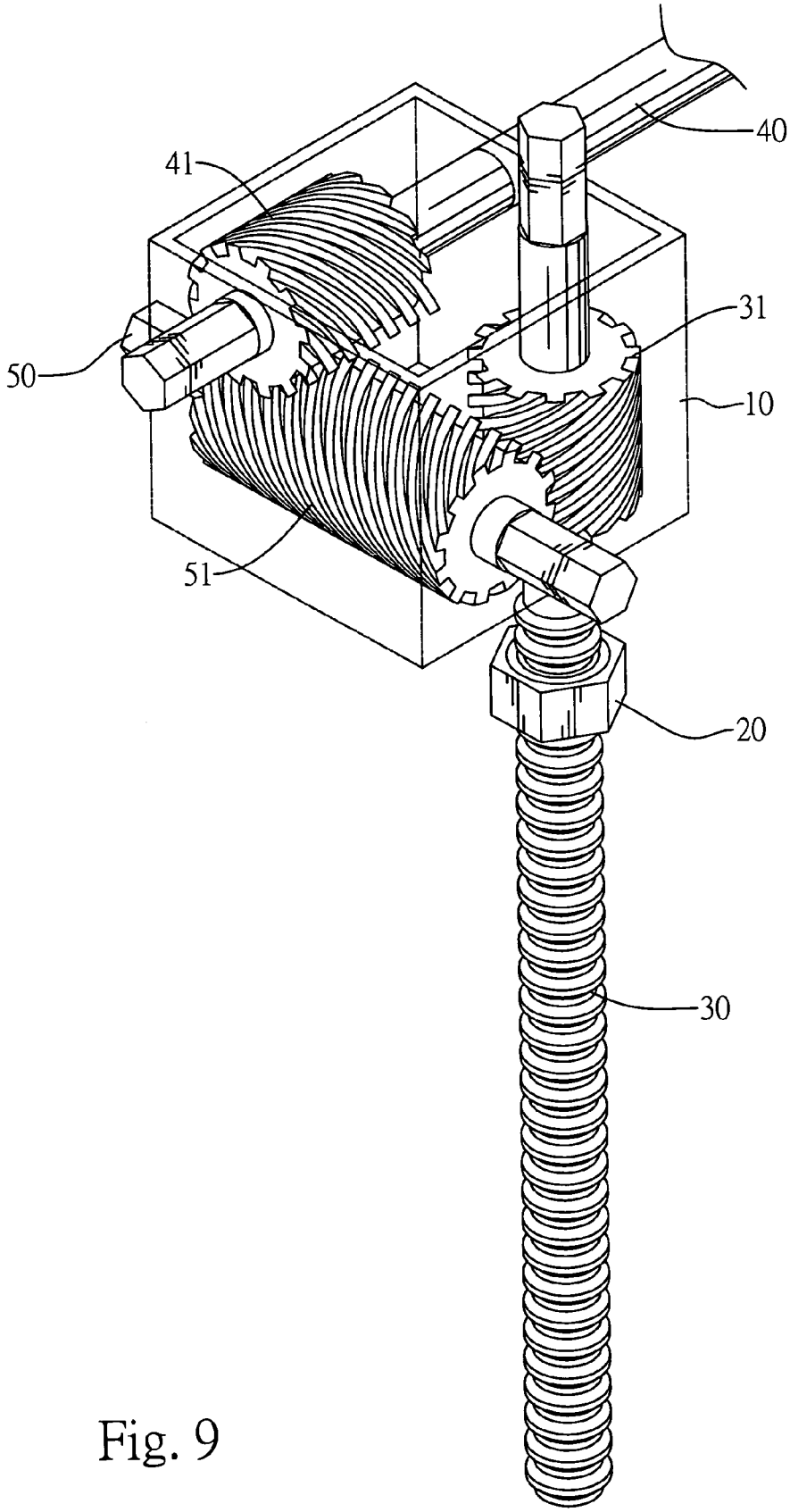
FIG. 9 is a perspective view of the elevating mechanism for furniture in FIG. 8.

Referring to FIGS. 8 and 9, the second preferred embodiment of the present invention as an elevating mechanism for furniture comprises a transmission unit, a rotary handle 60 and a box 10. The transmission unit further comprises a bolt 30 vertical to the ground, a first cylindrical gear 31 coaxially secured along a section of the bolt 30, a nut 20 engaged with a threaded section of the bolt 30, a horizontal first transmission shaft 40, a second cylindrical gear 41 coaxially secured along a section of the first transmission shaft 40, a horizontal second transmission shaft 50 and a third cylindrical gear 51 coaxially secured along a section of the second transmission shaft 50. The second transmission shaft 50 is disposed between the bolt 30 and the transmission shaft 40 and perpendicular to the first transmission shaft 40, whereby the third cylindrical gear 51 is engaged with both of the first cylindrical gear 31 and the second cylindrical gear 41. The top end of the bolt 30 forms a short post 61 with a polygonal cross section, and the first transmission shaft 40 and the second transmission shaft 50 each forms two short posts 61 with the same polygonal cross section at either side thereof. The rotary handle 60 is provided with a polygonal hole taking substantially the same shape as the cross section of the short posts 61. The hole is for receiving either one of the short posts 61 so as to rotate one of the first cylindrical gear 31, the second cylindrical gear 41 and the third cylindrical gear 51. The box 10 houses the first cylindrical gear 31 and the third cylindrical gear 51.

Figure 10:
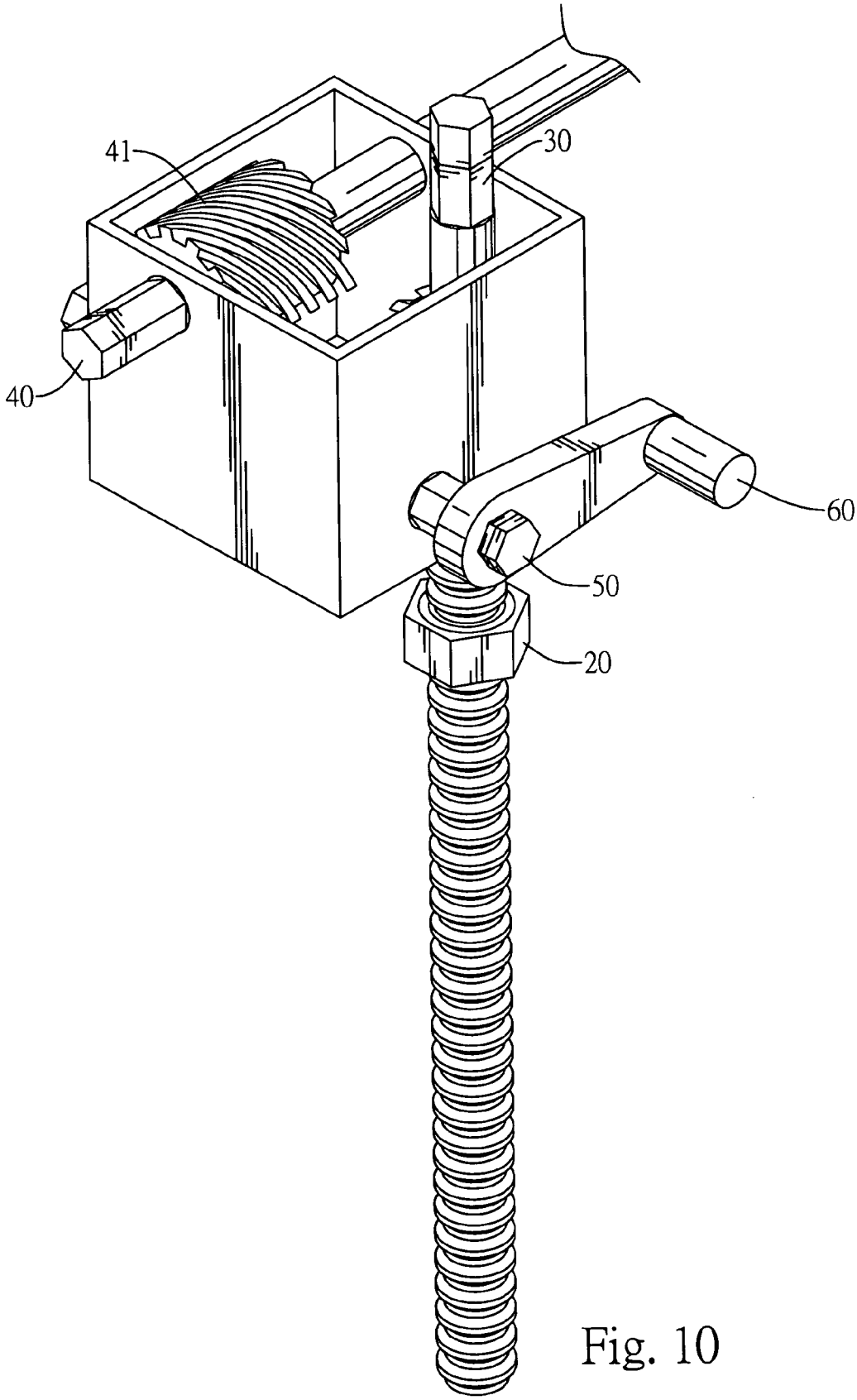
FIG. 10 is another perspective view of the elevating mechanism for furniture in FIG. 8.
Figure 11:
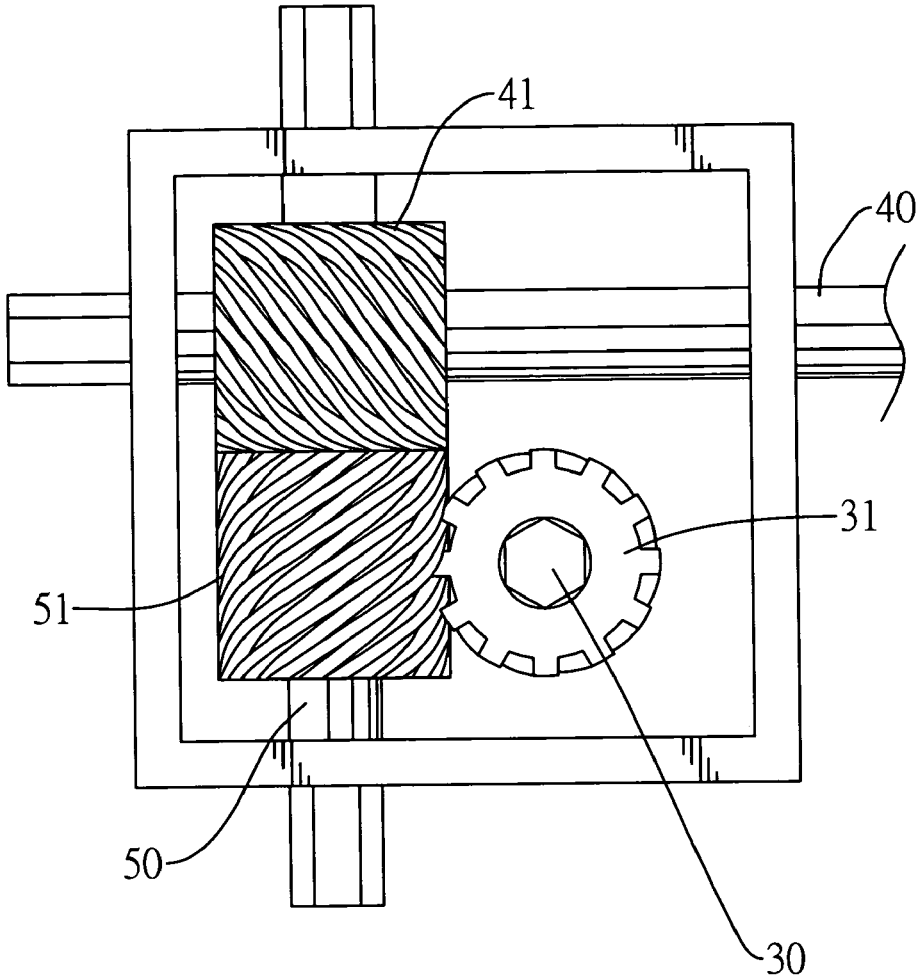
FIG. 11 is a top cross sectional view of the elevating mechanism for furniture in FIG. 8.

Referring to FIGS. 10 and 11, the rotation of either of the first transmission shaft 40 and the second transmission shaft 50 will drive the bolt 30 to rotate, since the first cylindrical gear 31, the second cylindrical gear 41 and the third cylindrical gear 51 are coupled. Therefore, with the engagement of the rotary handle 60 and either of the short post 61s, an elevation of the bolt 30 with respect to the nut 20 can be achieved.

Referring to FIG. 7, two sets of the elevating mechanism for furniture are installed within two table legs 71 of a table so that the height of table top 70 of the table can be adjusted, in which process the table top 70 keeps horizontal. The nut 20 of each elevating mechanism for furniture is secured within a corresponding table leg 71 for receiving the insertion of the bolt 30; other parts of the elevating mechanism for furniture is then mounted on the top end of each table leg 71. The table top 70 is supported by two boxes 10 of two sets of elevating mechanism. Two sets of elevating mechanism share the same transmission shaft 40 so that they move collaterally.

Referring to FIG. 12, the rotary handle 60 is connected to any of the short posts 61, whereby an external agent can urge a bolt 30 to rotate with respect to the associated nut 20. Because of the transmission unit, the other bolt 30 will move simultaneously with the bolt 30 being driven; therefore, the other bolt 30 will perform substantially the same rotation with respect to its associated nut 20. Thereby, two table legs 71 will be changing height at the same time.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An elevating mechanism for furniture, installed within a supporting base of an article of furniture so as to facilitate a vertical motion of a movable part relative to said supporting base, comprising:

a transmission unit comprising a bolt (30) and a first cylindrical gear (31); the first cylinder gear being coaxially secured along a section of the transmission unit and being located above the bolt (30); a top end of the bolt (30) forming a short post (61); a nut (20) engaged with a threaded section of the bolt (30), a horizontal transmission shaft (40) and a second cyliadrical gear (41) coaxially secured along a section of the transmission shaft (40) and coupled with the first cylindrical gear (31) of bolt (30);

two ends of the transmission shaft (40) forming two other short posts (61) with the same polygonal cross section as that of the short post (61) of the bolt (30); the rotary handle (60) being provided with a hole; the hole (61) serving for receiving either one of the short posts (61) so as to drive the first cylindrical gear (31) or the second cylindrical gear (41); and wherein in assembly, the first cylindrical gear (31) and the second cylindrical gear (41) are directly coupled such that the first cylinder gear (31) is in contact with the second cylindrical gear (41), the rotation of the transmission shaft (40) will cause the bolt (30) to rotate simultaneously, wherein the rotary handle (60) will activate a rotation of the bolt (30) with respect to the nut (20) and an upward or downward motion of the article connected to the bolt (30) with respect to the article on which the nut (20) is mounted.

2. The elevating mechanism for furniture of claim 1 further comprising a box for enclosing said first cylindrical gear and said second cylindrical gear, said short posts extending oat of said box through a plurality of holes thereon.

3. An elevating mechanism for furniture, installed within a supporting base of an article of furniture so as to facilitate a vertical motion of a movable part relative to said supporting base, comprising:

a transmission unit comprising a bolt (30) and a first cylindrical gear (31); the first cylinder gear being coaxially scoured along a section of the transmission unit and being located above the bolt (30); a top end of the bolt (3 ) forming a short post (61); a nut (20) engaged wit Ii a threaded section of the bolt (30);

a horizontal first transmission shaft (40) and a second cylindrical gear (41) coaxially secured along a section of the transmission shaft (40) and coupled with the first cylindrical gear (31) of bolt (30);

two ends of the first transmission shaft (40) forming two other short posts (61) with the same polygonal cross section as that of the short post (61) of the bolt (30); the rotary handle (60) being provided with a hole; the hole (61) serving for receiving either one of the short posts ( 61) so as to drive the first cylindrical gear (31) or the second cylindrical gear (41); and a horizontal second transmission shaft (50) and a third cylindrical gear (51) coaxially secured along a section of the second transmission shaft (50);

the second transmission shaft (50) being disposed between the bolt (30) and the first transmission shaft (40) and perpendicular to the first transmission shaft (40), wherein the third cylindrical gear (51) is directly engaged with both of the first cylindrical gear (31) and directly engaged to the second cylindrical gear (41).

4. The elevating mechanism for furniture of claim 3 further comprising a box for enclosing said first cylindrical gear and said second cylindrical gear. said short posts extending out of said box through a plurality of holes thereon.

* * * * *